US005687601A

United States Patent [19]

Caporusso et al.

[11] Patent Number: 5,687,601

[45] Date of Patent: Nov. 18, 1997

[54] GROUP FOR CLAMPING AND DRAGGING A PIPE OR ROD FOR PIPE BENDERS WITH OR WITHOUT AN INNER MANDREL AND ROD BENDERS, AND MACHINES FOR CLAMPING MECHANICAL PARTS IN GENERAL

[75] Inventors: Alessandro Caporusso; Mario Caporusso, both of Piedimonte S. Germano, Italy

[73] Assignee: C.M.L. Costruzioni Meccaniche Liri S.R.L., Piedimonte San Germano, Italy

[21] Appl. No.: 642,260

[22] Filed: May 3, 1996

[30] Foreign Application Priority Data

May 12, 1995 [IT] Italy ..... RM95A0310

[51] Int. Cl.[6] ..... B21D 7/04; B21D 9/05

[52] U.S. Cl. ..... 72/149; 72/159

[58] Field of Search ..... 72/149, 155, 159, 72/369, 409.19, 298; 269/256, 257, 229, 32, 34

[56] References Cited

U.S. PATENT DOCUMENTS

| | | | |
|---|---|---|---|
| 2,938,565 | 5/1960 | Klamm | 72/159 |
| 3,170,322 | 2/1965 | Cavanaugh | 269/256 |
| 3,242,710 | 3/1966 | Hamlin | 72/159 |
| 3,433,042 | 3/1969 | Crihfield et al. | 72/159 |
| 3,759,504 | 9/1973 | Hildebrand | 269/87 |
| 4,038,853 | 8/1977 | Schwarze | 72/157 |
| 4,760,726 | 8/1988 | Traub | 72/149 |

FOREIGN PATENT DOCUMENTS 0 076 783 4/1983 European Pat. Off. .

*Primary Examiner*—Lowell A. Larson
*Assistant Examiner*—Rodney A. Butler
*Attorney, Agent, or Firm*—Young & Thompson

[57] ABSTRACT

Vise for clamping a pipe or rod or section bar or other mechanical part, with a jaw (3) and a counterjaw (3'), comprising a piston fixed in position by a support (10) with a rod (6) to the head of which said counterjaw (3') is rendered integral through a cart (7); pliers with two catches (9, 9') hinged upon said support (10) to rotate vertically and endowed with hooks (*9a, 9a'*) fit for engaging two corresponding cavities (3a, 3a') provided on respectively upper and lower surfaces of said jaw, said catches having their profile with an inner and outer raising (**12, 12*a*; 12', 12*a'*) toward the exterior of the working field of the pliers themselves, said cart having two pegs (13, 13') respectively fit for engage each one of said outer raisings to cause the closing of the catches with the advancement of the cart by contrast against the outer raisings themselves, and pipe bending machine or rod or section bar bending machine that comprises it, with the jaw being integral with the matrix, as well as comprising a dragging ledge (16) integral with the matrix too, which ledge takes support on the dragging arm in the working sense of rotation, and is idling from it in the return sense, through an adjustable spacer (17**).

3 Claims, 3 Drawing Sheets

GROUP FOR CLAMPING AND DRAGGING A PIPE OR ROD FOR PIPE BENDERS WITH OR WITHOUT AN INNER MANDREL AND ROD BENDERS, AND MACHINES FOR CLAMPING MECHANICAL PARTS IN GENERAL

FIELD OF THE TECHNICS

The present invention generally relates to the field of the machines that make use of the clamping of mechanical parts.

More specifically, it relates to pipe benders, with or without an inner mandrel, and to rod or section bar benders.

In particular, it relates to a group for clamping and dragging a pipe or section bar for pipe benders of the type with a pulley bending matrix and a groove countermatrix.

BACKGROUND OF THE INVENTION

As is known, a pipe bender of the type with a pulley bending head and a groove countermatrix comprises, besides the matrix and the countermatrix, a group for clamping and dragging the pipe.

The group for clamping and dragging the pipe comprises a vise that clamps the pipe, and a dragging or towing arm, whereupon the vise is mounted.

The dragging arm is operated in rotation by a geared motor. Its rotation causes the vise that clamps the pipe to advance, which pipe is so forced to bend along the groove of the matrix, which is idling on its shaft, against the support offered by the countermatrix.

The vise is made up of a jaw integral with the pulley matrix, eventually even unitary, i.e. manufactured as a single piece with it, and of a counterjaw.

The clamping group comprises, moreover, a piston, fixed in position along the dragging arm through a support. The counterjaw is rendered integral with the head of the rod of such a piston.

The vise is so fit for clamping a pipe under the operation thrust of the piston.

The driving force for the operation of bending a pipe is provided by the torque output by the drive shaft of a geared motor.

In prior art solutions the jaw, and so the groove pulley matrix, is rendered integral with the dragging arm through a coupling element, particularly through a pin. More precisely, the jaw (integral or even unitary with the groove pulley matrix) presents a through hole which is brought in register with a hole correspondingly made in the dragging arm, and a peg or cylindrical pin is inserted in the two, to render precisely integral the bodies of the dragging arm and of the jaw.

The peg or cylindrical pin projects superiorly from the jaw and a bracket goes to hook itself, hinged on the support of the piston to rotate vertically.

The operation is as follows. Having made the pipe to be bent to pass between the matrix and the countermatrix and between the jaw and the counterjaw of the clamping vise, one clamps the vise and closes the hooking catch. At this point one can bend the pipe. Once the bending operation made, to free the working field it is necessary to lift the bracket, to move away the counterjaw and to take away the pinning cylindrical pin to disengage the pipe.

From this analysis of prior art it results, as a remarkable datum, that the dragging force unloads itself on the pipe through the aforementioned coupling element between the jaw and the dragging arm, made up of pinning cylindrical pin in the disclosed case.

Some drawbacks are associated with prior art groups for clamping and dragging the pipe, whereof the construction disclosed above is exemplary.

The forces that act on the vise for clamping the pipe during the bending operation (dragging) turn out to be unbalanced, with the result of a deviation from parallelism of the faced faces of the groove jaw and counterjaw of the generatrices of the pipe to be bent, with a negative result on the pipe to be bent, in that the vise has to ensure the clamping of the pipe between the jaw and the counterjaw and the dragging of the pipe itself at a time.

Moreover, when a bending operation has been completed and it is necessary to take away the pipe to free the working field, it turns out to extract the above mentioned peg or pin.

The object of the present invention is to provide a group for clamping the pipe or rod or bar or section iron or other mechanical particular wherein the clamping forces are balanced with nullification of mechanical plays.

A further object of the present invention is to provide a group for clamping and dragging a pipe or bar for pipe benders or rod or bar benders that allows a locking/unlocking, with the return to an idle state of the dragging arm relative to the matrix idling on its shaft, substantially quicker than those of prior art, with a single manoeuvre by the operator.

SUBJECT OF THE INVENTION

Therefore, it is the subject of the present invention a vise for clamping a pipe or rod or section bar or other mechanical part,comprising a jaw and a counterjaw, characterized in that it comprises a piston fixed in position by a support with a rod to the head of which said counterjaw is rendered integral through a cart; pliers with two catches hinged upon said support to rotate vertically and endowed with hooks fit for engaging two corresponding cavities provided on respectively upper and lower surfaces of said jaw, said catches having their profile with an inner and outer raising toward the exterior of the working field of the pliers themselves, said cart having two pegs respectively fit for engaging each one of said outer raisings to cause the closing of the catches with the advancement of the cart by contrast against the outer raisings themselves, the opening of the catches in the backward motion being caused by the contact of the profile of the counterjaw itself against the inner raising of the catches.

The present invention also has as its subject such a vise, further characterized in that said piston is assembled in said support through a threading provided at the exterior of its cylinder; that it is operated by a lever assembled on an outer projection of the cylinder, through a toggle with two links hinged through a pin integral with said lever and respectively hinged with said projection and said rod.

Finally, a pipe bending machine or rod or section bar bending machine comprising an idling matrix and a dragging arm costitutes subject of the present invention, Characterized in that it comprises a vise for clamping the pipe or rod or section bar mounted on said dragging arm as set forth, the jaw being integral with the matrix, and that it comprises a dragging ledge integral with the matrix, which ledge takes support on the dragging arm in the working sense of rotation, and is idling from it in the return sense, through an adjustable spacer.

BRIEF DISCLOSURE OF THE DRAWINGS

Further features and advantages of the present invention will become apparent from the following detailed disclosure of its preferred embodiment, given only as a matter of example, absolutely not of restriction, with reference to the annexed drawings, wherein:

FIG. 1 is a partially cutaway side view of the group for clamping and dragging a pipe according to the present invention, with the vise for clamping the pipe in the locked state;

FIG. 2 is a right section view of the dragging arm of the pipe bender, along line A—A of FIG. 1, FIG. 3 is again a side view of the group for clamping and dragging according to the present invention, with the vise for clamping the pipe in the locked state, and FIG. 4 is again a side view of the group for clamping and dragging the pipe according to the present invention, which further shows a safety device therefor.

DETAILED DESCRIPTION OF THE PREFERRED EMBODIMENT

Figure 1:
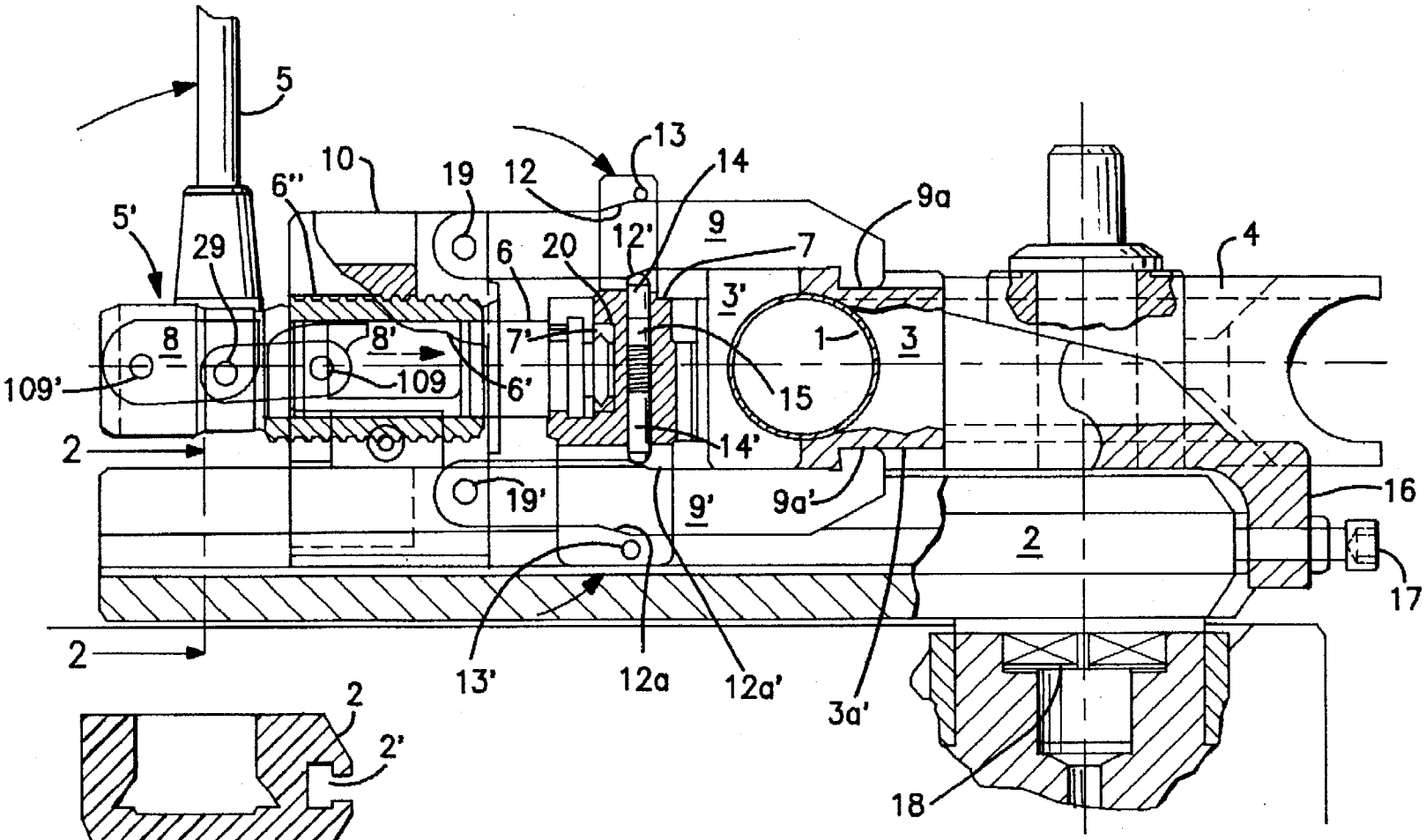

With reference to FIG. 1, the group for clamping and dragging pipe 1 according to the present invention is mounted in a dragging arm 2, which is operated in rotation by the output shaft 18 of a geared motor.

Figure 2:
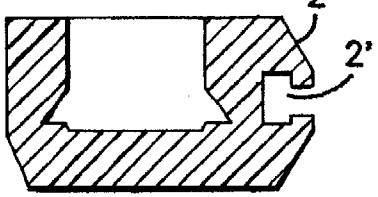

As shown in FIG. 2, the dragging arm 2 has a dove tail right section, along which the members are arranged that cooperate to the end of clamping the pipe 1 that is to be bent.

The clamping group of the present invention includes a vise made up of a jaw 3 and of a counterjaw 3'. Jaw 3 is integral with groove pulley matrix 4 of the bending head, and could also be unitary, i.e. manufactured as a single piece, with it.

The clamping group comprises, moreover, as an operation means, a piston supported on the dragging arm 2 through a support 10. This is fixed in position along the dove tail guide of the dragging arm 2 as a function of the size of matrix 4 mounted idlingly on the bending head.

The piston actuates the clamping of the vise upon the pipe to be bent 1 through the displacement of its rod 6, at the extremity whereof a cart 7 is mounted, wherewhich counterjaw 3' is rendered integral.

The actuation of the displacement of rod 6 according to the preferred embodiment of the present invention is hand operated through a lever 5 mounted on a support 5' integral with cylinder 6' of the piston, and connected with rod 6 through a toggle made up of two links 8, 8' hinged with a common pin 29 integrally with lever 5 and respectively with a pin 109' to support 5' and 109 to rod 6.

The jaw and the counterjaw are tightened together by pliers Operating vertically made up of two hooking catches, an upper one 9 and a lower one 9', identical to each other and mounted reciprocally specular, hinged to rotate vertically with respective pins 19, 19' on support 10. These catches have at their free, working end, respective hooks **9*a*, 9*a'* that grasp jaw 3 engaging themselves with respective complementary cavities 3*a*, 3*a'*** provided on the jaw itself.

The quick locking and unlocking of the pliers are controlled with the following construction.

Catch 9 has, on the outer side, a raising profile 12 and an again raising profile 12' on the inner side. Catch 9', as mentioned above, has a profile specular to catch 9, with corresponding outer **12*a* and inner 12*a'*** raisings.

Cart 7 has two projections, the one on the upper side, the other on the lower side, that bear respective stakes 13, 13' fit for engaging the outer contour of the hooking catches.

When with the piston through quick approach lever 5 one approaches the counterjaw to the jaw, the outer raisings engage with the stakes, which with the accompanying forward motion of the cart tighten the catches of the pliers.

When one drives the backward motion of the counterjaw, the contour of the counterjaw itself comes in abutment with the inner raisings of the contour of the catches, causing them to open.

As an aid to the opening of the catches in the backward motion, two spring loaded pins projecting above and below 14, 14' are mounted in cart 7.

Figure 3:
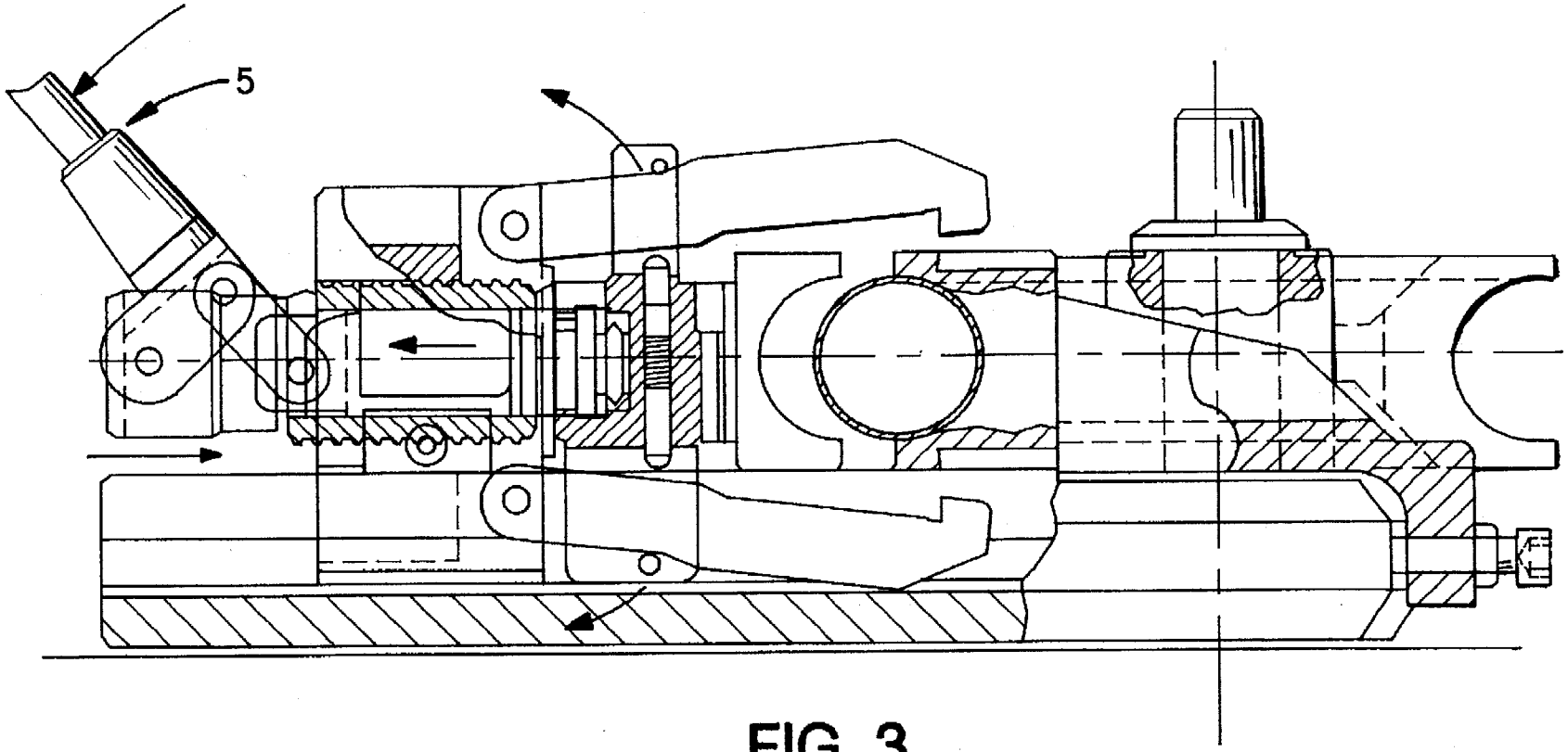

The opening of the vise is better illustrated in FIG. 3. As this figure shows, the quick opening is induced by a backward rotation of lever 5.

An adjustable dragging support ledge 16 is integral or unitary with pulley matrix 4. More precisely, it abuts against an end of dragging arm 2 with a micrometric adjustment screw 17.

Figure 4:
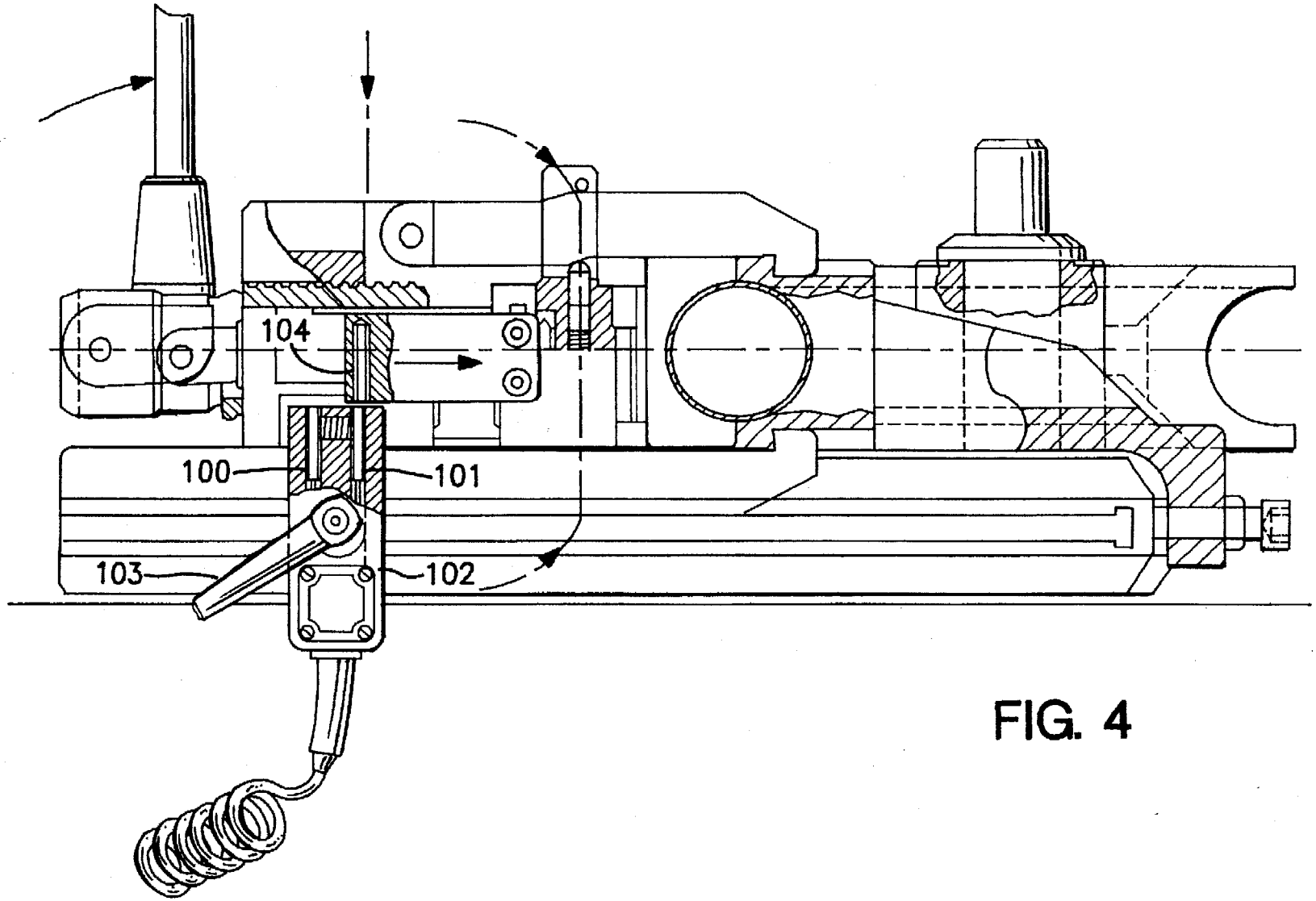

With reference to FIG. 4, the clamping group of the present invention is further endowed with a safety device that gives the consent to the start of the pipe bending operation or to the return only if, respectively, the jaws are closed or open.

The safety device comprises a holdfast 102 that establishes the position of the vise. Through a lever 103 one actuates a tightening screw in the correct position along the guide offered by a T hollow 2' along dragging arm 2 (see FIG. 2).

The device includes two proximity sensors making up limit switches 100 and 101. A third proximity sensor 104 is supported integral with cart 7, which in the closed position of the vise brings itself in register with sensor 101, enabling the start, and in the open position of the vise brings itself in register with sensor 100, enabling the return.

With reference again to FIG. 1, it can be remarked that the exterior of cylinder 6' of the piston is threaded and engages itself in a corresponding inner threading of support 10. Threading 6" of cylinder 6' allows to rotate through lever 5, linearly displacing the piston so as to absorb the plays of the toggle quick approach mechanical group, as well as the other plays to give the group the greatest possible closing rigidity. As an aid to the achievement of the nullification of the plays due to the use of the vise group one can insert adjustment rings 20 between cart 7 and thrust bearing 7' through which the cart itself is mounted on rod 6, or other adjustment systems.

For the disclosed constitution, the group for clamping and dragging the pipe of the present invention has the following features:

- the reciprocal tightening forces of the jaw and the counterjaw in static conditions are balanced;
- through micrometric screw 17 it is possible to balance the forces during a bending operation, a balancing that is achieved when the jaw and the counterjaw reach the parallelism with the generatrices of the pipe to be bent;
- through the piston one controls both the unlocking and the freeing of the pipe from the clamp, as the unlocking of the pliers is simultaneous with the withdrawal of counterjaw 3' from jaw 3.

Therefore, the disclosed system achieves the objects of the present invention.

The present invention has been disclosed and illustrated with reference to a specific embodiment thereof, but it is to be expressedly understood that variations, additions and/or omissions can be made, without so departing from its spirit and protection scope.

For instance, a hand operated actuation lever has been disclosed, but the actuation could also be servoassisted.

Therefore, the original teaching presented is defined by the claims.

We claim:

1. A vise for clamping a pipe or rod or section bar or other mechanical part, comprising a jaw (3) and a relatively movable counterjaw (3'), a support (10) housing a piston (6) to which said counterjaw (3') is rendered integral through a cart (7);

pliers with two catches (9, 9') hinged upon said support (10) to rotate vertically and endowed with hooks (9*a*, 9*a'*) for engaging two corresponding cavities (3*a*, 3*a'*) provided on respectively upper and lower surfaces of said jaw, said catches having their profile with an inner and outer raising (12, 12*a*; 12', 12*a'*) exteriorly of a working field of the pliers themselves, said cart having two pegs (13, 13') respectively fit for engaging each one of said outer raisings to cause the closing of the catches by way of advancement of said cart in a forward direction against said outer raisings themselves, an opening of the catches being caused by backward motion of said cart and by contact of an outer profile of the counterjaw (3') itself against the inner raising (12', 12*a'*) of the catches.

2. The vise according to claim 1, wherein said piston is assembled in said support (10) through a threading (6") provided at the exterior of its cylinder;

said vise being operated by a lever (5) assembled on an outer projection (5') of the cylinder, through a toggle with two links (8, 8') hinged through a pin (29) integral with said lever and respectively hinged with said projection (5') and said rod.

3. A pipe bending machine or rod or section bar bending machine comprising an idling matrix and a dragging arm, a vise according to claim 1 for clamping the pipe or rod or section bar mounted on said dragging arm, the jaw being integral with the matrix, and comprising a dragging ledge (16) integral with the matrix, which ledge takes support on the dragging arm in the working sense of rotation, and is idling from it in the return sense, through an adjustable spacer (17).

* * * * *